US011385015B2

(12) United States Patent
Coalson et al.

(10) Patent No.: US 11,385,015 B2
(45) Date of Patent: Jul. 12, 2022

(54) BOW STAND FOR SPLIT LIMB ARCHERY BOWS

(71) Applicant: Good Sportsman Marketing, L.L.C., Irving, TX (US)

(72) Inventors: Damon Lamont Coalson, Dallas, TX (US); Anthony T. LoRocco, Richardson, TX (US); John Estridge, Garland, TX (US)

(73) Assignee: GOOD SPORTSMAN MARKETING, L.L.C., Irving, TX (US)

( * ) Notice: Subject to any disclaimer, the term of this patent is extended or adjusted under 35 U.S.C. 154(b) by 0 days.

(21) Appl. No.: 16/952,075

(22) Filed: Nov. 18, 2020

(65) Prior Publication Data

US 2022/0018628 A1 Jan. 20, 2022

Related U.S. Application Data

(60) Provisional application No. 62/901,794, filed on Sep. 18, 2019.

(51) Int. Cl.
*F16M 11/00* (2006.01)
*F41B 5/14* (2006.01)

(52) U.S. Cl.
CPC ..... *F41B 5/1453* (2013.01)

(58) Field of Classification Search
CPC ..... F41B 5/1453; F16B 2/12; F16M 11/04; F16M 11/24; F16M 11/26
See application file for complete search history.

(56) References Cited

U.S. PATENT DOCUMENTS

| | | | | |
|---|---|---|---|---|
| 3,235,997 | A * | 2/1966 | Stoner | F41A 23/08 89/37.03 |
| 8,931,470 | B1 * | 1/2015 | Khoshnood | F41B 5/1426 124/89 |
| 9,568,270 | B1 * | 2/2017 | LoRocco | F41B 5/14 |
| 9,638,488 | B1 * | 5/2017 | Broberg | F41B 5/1453 |
| D819,159 | S * | 5/2018 | Leis | F41B 5/1426 D22/107 |
| 2004/0149867 | A1 * | 8/2004 | Johnson | F41B 5/1453 248/146 |

* cited by examiner

*Primary Examiner* — Amy J. Sterling
(74) *Attorney, Agent, or Firm* — D'Ambrosio & Menon, PLLC; Usha Menon

(57) ABSTRACT

An archery bow stand is provided supporting generally wide split-limb archery bows that include first and second limb segments separated by an elongated slot. The bow stand includes identical first and second legs t pivotally connected together such that the inner surface of one leg faces the inner surface of the other leg. First and second upper clamp portions associated with the first and second legs, respectively, extend in opposite directions. The clamp portions are received in the elongate slot between the limb segments so that the clamp portions extend generally parallel therewith. The bow stand is then rotated about a longitudinal axis so that the clamp portions extend perpendicular to the limb segments with an open gap of each clamp portion receiving one of the limb segments to hold the split-limb archery bow in an upright position when not in use.

15 Claims, 8 Drawing Sheets

BOW STAND FOR SPLIT LIMB ARCHERY BOWS

CROSS-REFERENCE TO RELATED APPLICATIONS

This application claims the benefit of U.S. Provisional Application No. 62/901,794 filed on Sep. 18, 2019, the disclosure of which is hereby incorporated by reference.

BACKGROUND OF THE INVENTION

This invention relates generally to the field of archery, and more particularly to an archery bow stand for supporting a bow on the ground or other surface.

Bow stands are often used to temporarily free up the archer's hands and need to be installed and removed from the bow quickly and often. When not on the bow, the need for the stand to be compact is important so it can be slipped into a pocket or backpack. Large one-piece, non-folding stands, are difficult to store when not in use.

Bow limbs also vary in thickness often from one end of the bow to the other and typically are not the same thickness from manufacturer to manufacturer. For a stand to reliably support a bow, the stand would need to have means for accommodating changes in limb thickness.

In addition, the necessity of being able to independently support an archery bow to free the archer's hands while at an archery range or during hunting has long been recognized. Accordingly, prior art archery bow stands have been proposed that vary widely in function and design, with the ultimate purpose of freeing the archer's hands while resting or when engaged in other activities where the archery bow is not needed.

One particular type of bow stand that has grown in popularity is a scissor-type configuration where two arms are pivotally connected together, with one end of each arm functioning as a ground support portion and the opposite end of each arm functioning a clamping portion that engages opposing outer edges of the archery bow limb. A tension spring extends between the arms and, because of its position with respect to the pivot point of the arms, positively holds the bow stand in an open position with the spring located below the pivot point so that the bow stand can be positioned on the bow limb, and positively holds the bow stand in a closed position with the spring shifted to a location above the pivot point as the arms are rotated, so that the clamping portions of each arm exerts an inward biasing force against the opposing outer edges of the archery bow limb, thereby clamping the bow limb between the arms, while the ground support portions are spread apart in a relatively wide stance to engage the ground in a tripod-like fashion with a pulley or other portion of the archery bow functioning as a third ground support portion. Although this type of bow stand is widely used, the exposed spring on these types of bow stands can be problematic, both to the user, and the user's equipment, which may be exposed to being pinched or scratched by the spring or other component of the bow stand.

In addition, such bow stands are relatively low in cost and therefore do not provide protection for the surfaces of the archery bow they come in contact with, such as the limb of a bow. Since bow limbs operate under very high tensile and compression stresses, damage to the limbs caused by archery equipment or accessories, such as the scissor-type bow stand, can be problematic and eventually lead to degradation in bow performance and potentially compromise the safety of the archer when repeated damage occurs over time.

Moreover, since such scissor-type bow stands are configured with clamping portions that face inwardly toward each other for engaging the outside edges of the archery bow limb so that the bow limb is captured between the clamping portions, they are unable to accommodate bows with wide limbs, such as split-limb bows with parallel limb segments separated by an elongate slot. These types of split-limb archery bows are typically too wide to be used with conventional scissor-type bow stands, since the clamping portions cannot practically reach around the outside edges of the spaced limb segments. Accordingly, there remains a need to provide a bow stand that is relatively simple in construction yet capable of accommodating bows with limbs that are too wide for conventional scissor-type bow stands.

It would therefore be desirous to provide a bow stand that overcomes one or more disadvantages of the prior art.

SUMMARY OF THE INVENTION

In accordance with one aspect of the invention, a bow stand for supporting an archery bow having a lower split limb portion with first and second limb segments separated by an elongate slot is provided, and includes at least one leg for supporting the archery bow, at least one upper clamp portion associated with the at least one leg and including: an upright clamp section, a lower clamp section extending perpendicularly from the upright clamp section, an upper clamp section spaced from the lower clamp section and extending perpendicularly from the upright clamp section, at least one open gap formed between the upright clamp section, the upper clamp section, and the lower clamp section, the at least one gap being of sufficient height for receiving at least one of the first and second limb segments. The at least one upper clamp portion is adapted for being positioned in the elongate slot in a first orientation with the upper clamp portion extending parallel with the limb segments, and is rotatable about a vertical axis to a second orientation perpendicular to the first orientation such that the upper clamp section is oriented perpendicular to the first and second limb segments with the at least one open gap receiving at least one of the first and second limb segments to thereby retain the lower split limb portion on the bow stand.

In accordance with a further aspect of the invention, an archery bow stand for supporting a split-limb archery bow in an upright position having first and second limb segments separated by an elongate slot. The archery bow stand includes a first leg having a first lower support portion adapted for contacting a surface and a first upper clamp portion with a first gap facing a first direction for receiving the first limb segment, and a second leg having a second lower support portion adapted for contacting the surface and a second upper clamp portion with a second gap facing a second direction opposite the first direction for receiving the second limb segment, with the first and second legs being pivotally connected together in proximity to the first and second upper clamp portions for relative pivotal movement of the first and second legs to at least a first position where the first and second gaps are aligned. In this manner, the first and second upper clamp portions are adapted to be received in the elongate slot of the lower split limb portion with the upper clamp portions extending parallel with the first and second limb segments, such that rotation of the archery bow stand about a vertical axis causes the first and second upper clamp portions to rotate in the elongate slot to a perpendicular position with respect to the first and second limb segments, such that the first gap receives one of the first and second limb segments and the second gap receives the other of the first and second limb segments to thereby retain the archery bow on the archery bow stand in the upright position.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

Figure 1:
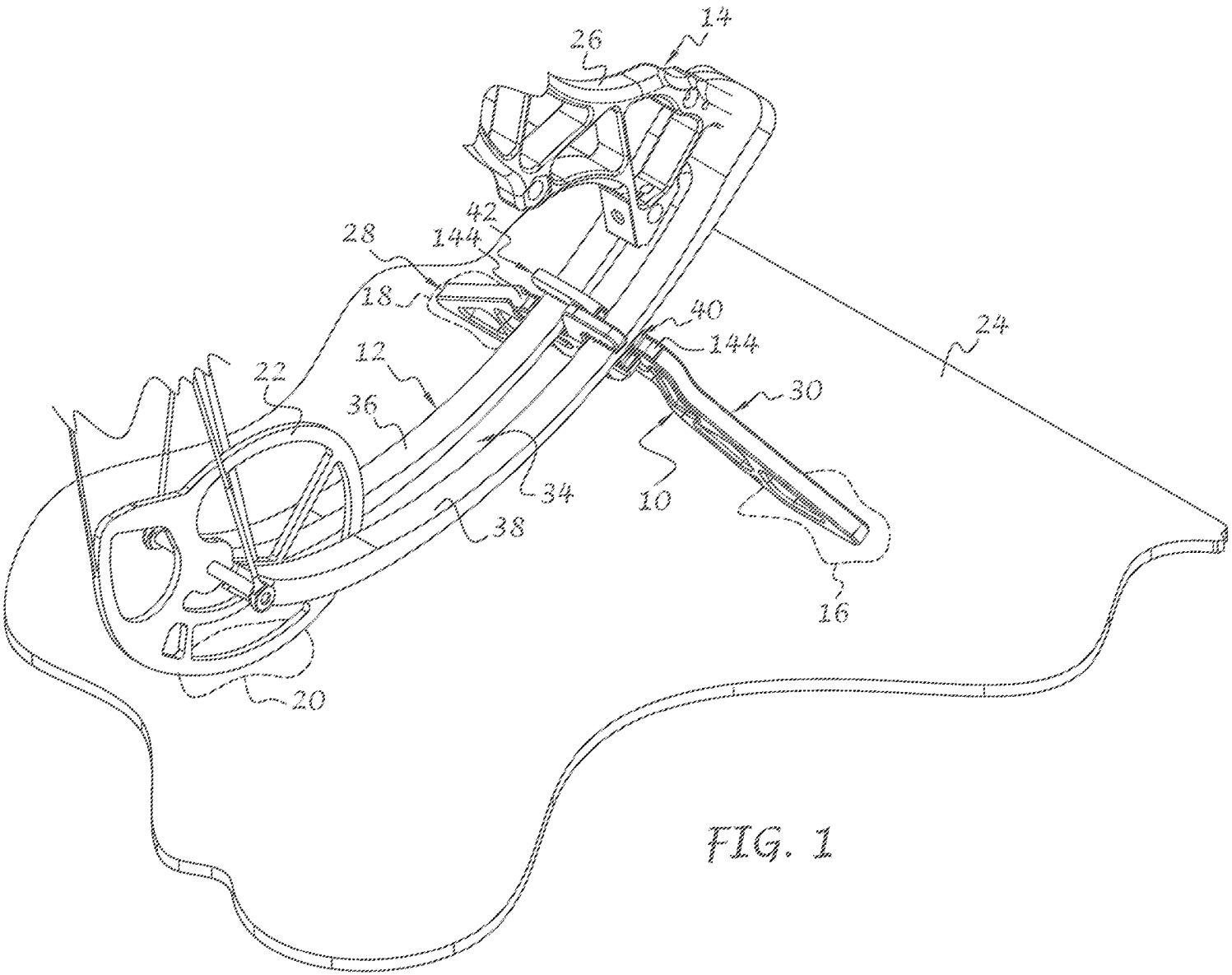
FIG. 1 is a rear perspective view of an archery bow stand in accordance with an exemplary embodiment of the invention connected to a split-limb archery bow, shown in partial view.

It is noted that the drawings are intended to depict only typical embodiments of the invention and therefore should not be considered as limiting the scope thereof. It is further noted that the drawings are not necessarily to scale, and therefore relative dimensions or sizes of the illustrated elements can greatly vary+. The invention will now be described in greater detail with reference to the accompanying drawings.

DETAILED DESCRIPTION OF THE INVENTION

Referring now to the drawings, and to FIGS. 1-4 in particular, an archery bow stand 10 in accordance with an exemplary embodiment of the present invention is illustrated connected to an archery bow 14 (only partially shown in FIG. 1) in a unique manner for holding the bow in an upright position when not in use. The bow stand 10 preferably includes a first leg 28 pivotally connected to a second leg 30 identical to the first leg 28, with clamp portions 40 and 42 for attaching to the lower limb 12 of the bow 14, such as a split-limb compound bow, as shown, so that the bow stand 10 forms a first ground support region or area 16 (shown in broken line in FIG. 1) associated with a first bottom support surface 78 of the first leg 28, and a second ground support region or area 18 (broken line FIG. 1) associated with a second bottom support surface 78 of the second leg 30, while the bow 14 forms a third ground support region or area 20 (broken line FIG. 1) associated with at least one component or accessory of the bow 14, such as the pulley and/or cam 22 mounted at an end of the lower split limb 12, as well as a stabilizer, or other component or accessory. The three ground support regions create a stable tripod support to hold the bow 14 in an upright position on the ground or other generally horizontal surface 24 when at rest. Although the present invention is illustrated in conjunction with a compound bow 14, it will be understood that the bow stand 10 can be used with other types of archery bows, such as longbows, recurve bows, crossbows, and so on, as well as other firearms or other devices where a bipod or tripod support may be desirable, especially where a gap extends between limb portions of the longbow, recurve bow, crossbow, and so on, without departing from the spirit and scope of the invention.

Figure 2:
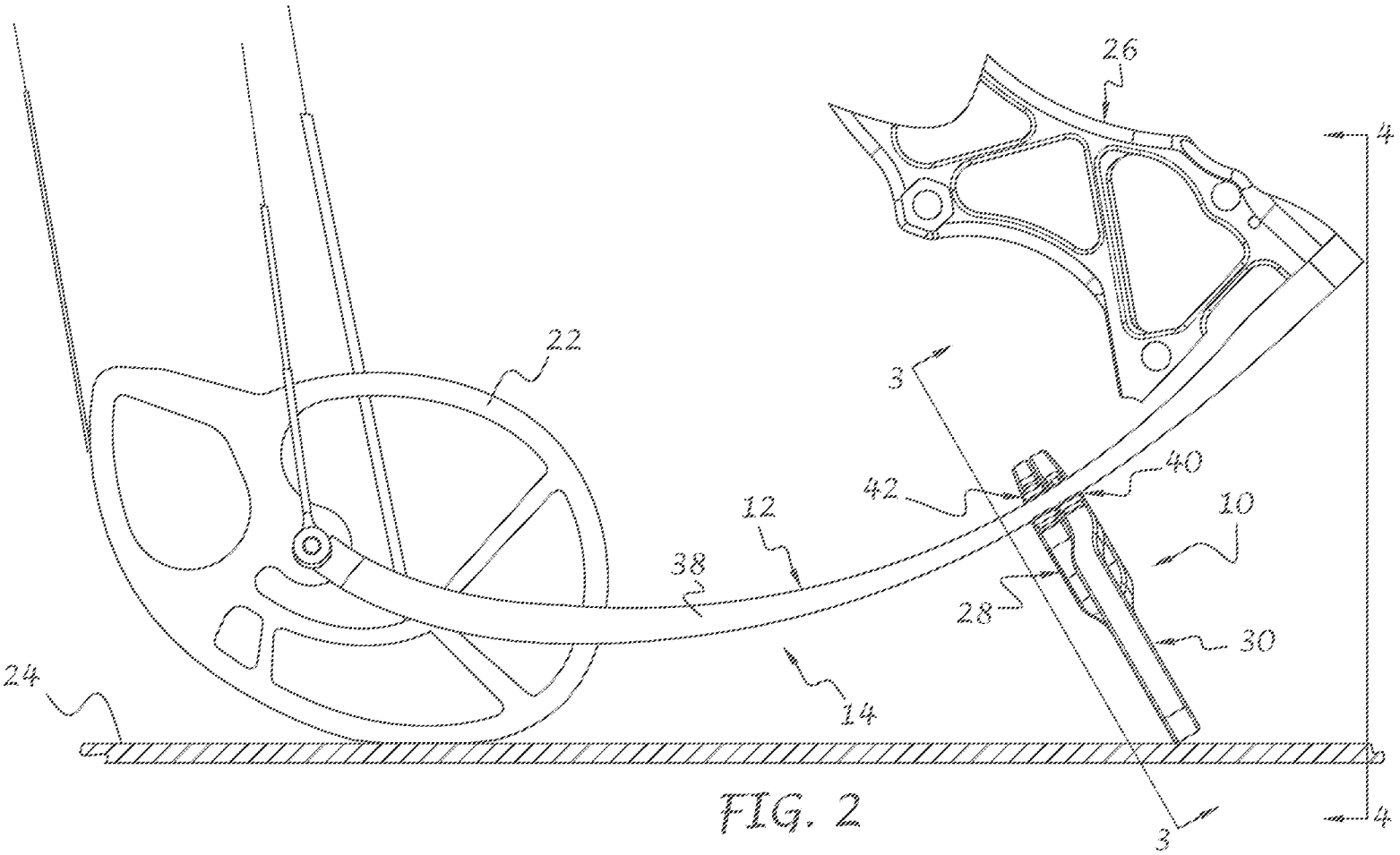
FIG. 2 is a side view of the archery bow stand of FIG. 1 connected to a split-limb archery bow in an open position for supporting the bow on the ground or other surface generally oriented in a horizontal plane.

As shown in FIG. 2, although the archery bow stand 10 can be positioned at any convenient location along the lower limb 12 when connected thereto, the particular position along the length of the lower limb 12 is preferably selected to maximize stability of the tripod support and thus stability of the archery bow 14 in a generally upright position. As shown, the bow stand 10 is positioned near the riser 26 (partially shown in FIG. 2), and extends at an obtuse angle with respect to the surface 24. This angle is dependent at least in part on the curvature and length of the lower limb 12, as well as the height of the cam 22 extending below the lower limb 12. In the position as shown, the center of gravity of the archery bow 14 is preferably located vertically over the archer bow stand 10 or slightly in front of the bow stand, to ensure that the bow does not tip forward or backward while being held in the upright position.

Figure 3:
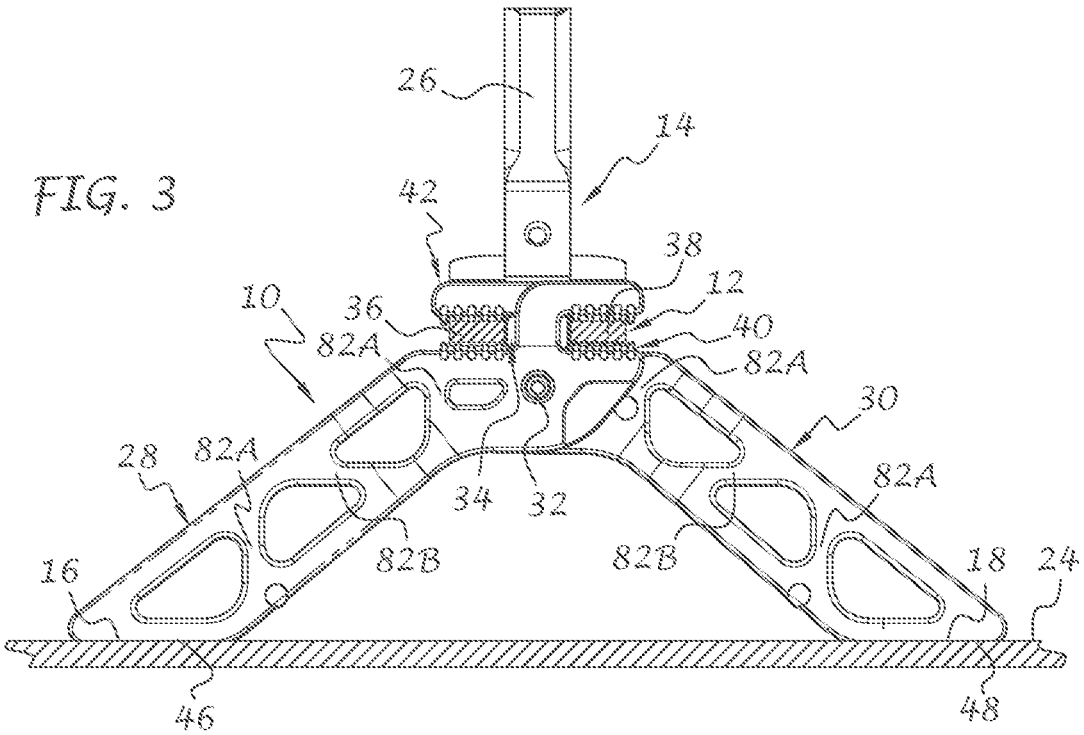
FIG. 3 is a rear view of the archery bow stand connected to a split-limb archery bow shown in partial section view along line 3-3 of FIG. 2.
Figure 4:
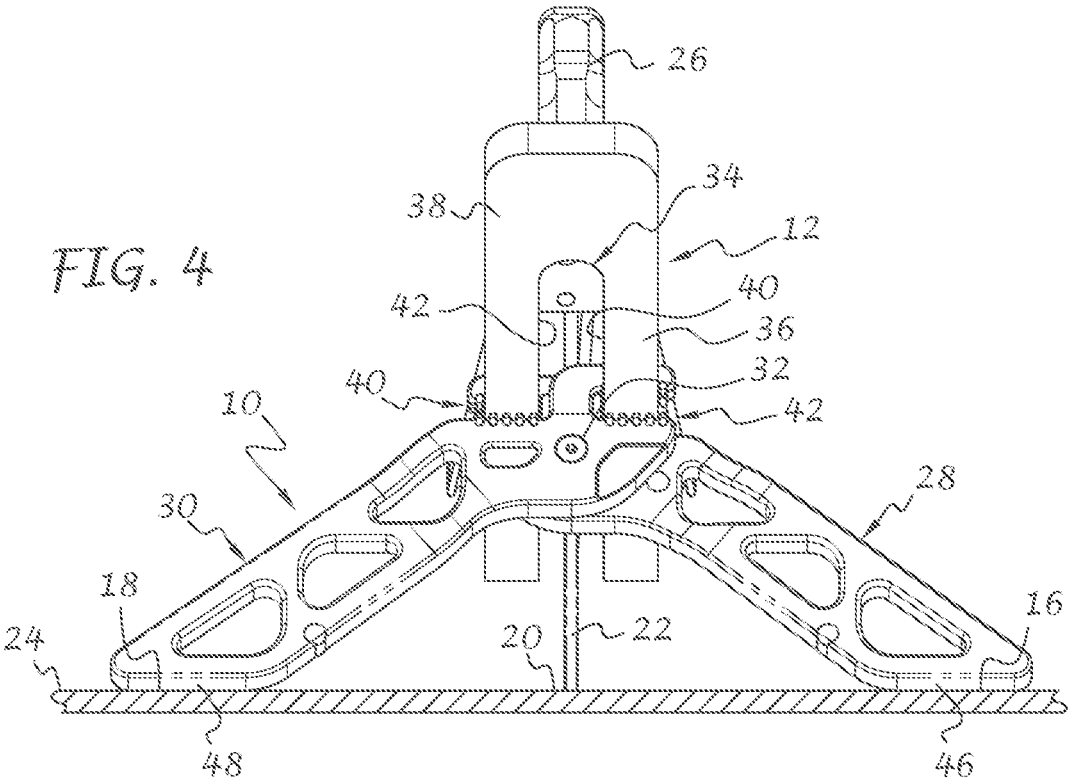
FIG. 4 is a front elevational view of the archery bow stand of the invention connected to a split-limb archery bow as viewed along line 4-4 of FIG. 2, showing a pulley of the archery bow positioned between the legs of the bow stand.

As shown in FIGS. 3 and 4, the archery bow stand 10 includes a first leg 28 pivotally connected to a second leg 30 via a pivot joint 32 for rotating the bow stand 10 between a closed position (FIG. 11) for storage and transportation for example, in a convenient, compact manner, and an open position (FIG. 2) for connection with the lower split limb 12 to thereby hold the archery bow 14 in an upright position when a bipod or tripod mount is desirable, as previously described.

As shown in FIG. 4, the lower limb 12 comprises a split limb having an elongate center slot 34 located between a first lower limb segment 36 and a second lower limb segment 38. The archery bow stand 10 includes a first clamp portion 40 extends outwardly in a first direction and a second clamp portion 42 extends outwardly in a second direction opposite the first direction. The clamp portions 40 and 42 comprise cooperating features associated with the first leg 28 and the second leg 30, as will be described in greater detail below. When the archery bow stand 10 is connected to the bow 14, the first clamp portion 40 and second clamp portion 42 are located in the elongate center slot 34 and extend around the first lower limb segment 36 and the second lower limb segment 38, respectively, when in the clamped position. The first and second clamp portions are preferably symmetrically arranged, so that the cam 22 is centered with respect to the outer support section 46 of the first leg 28 and the outer support section 48 of the second leg support portion 30.

Figure 5:
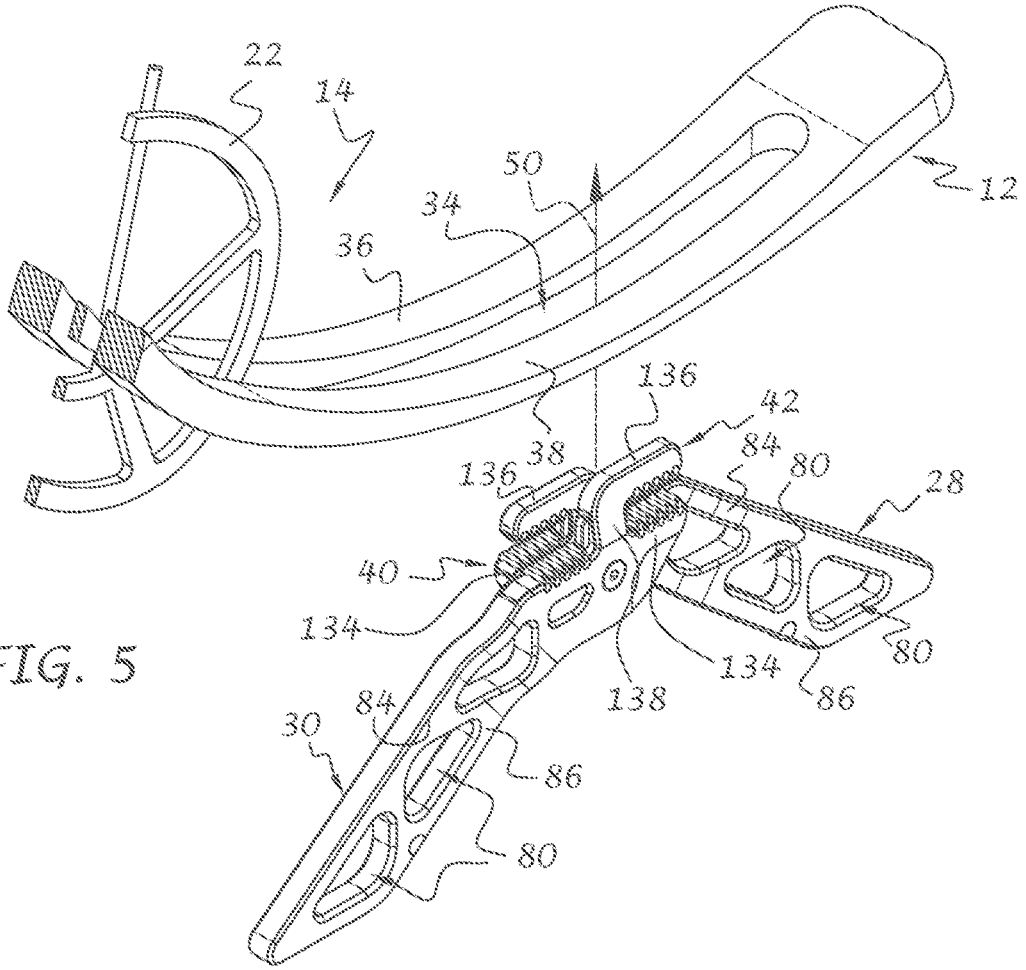
FIG. 5 is a right rear isometric view of the archery bow stand in an open position, oriented parallel with a slot between the split limb portions for connecting the archery bow stand to the split-limb archery bow.
Figure 5A:
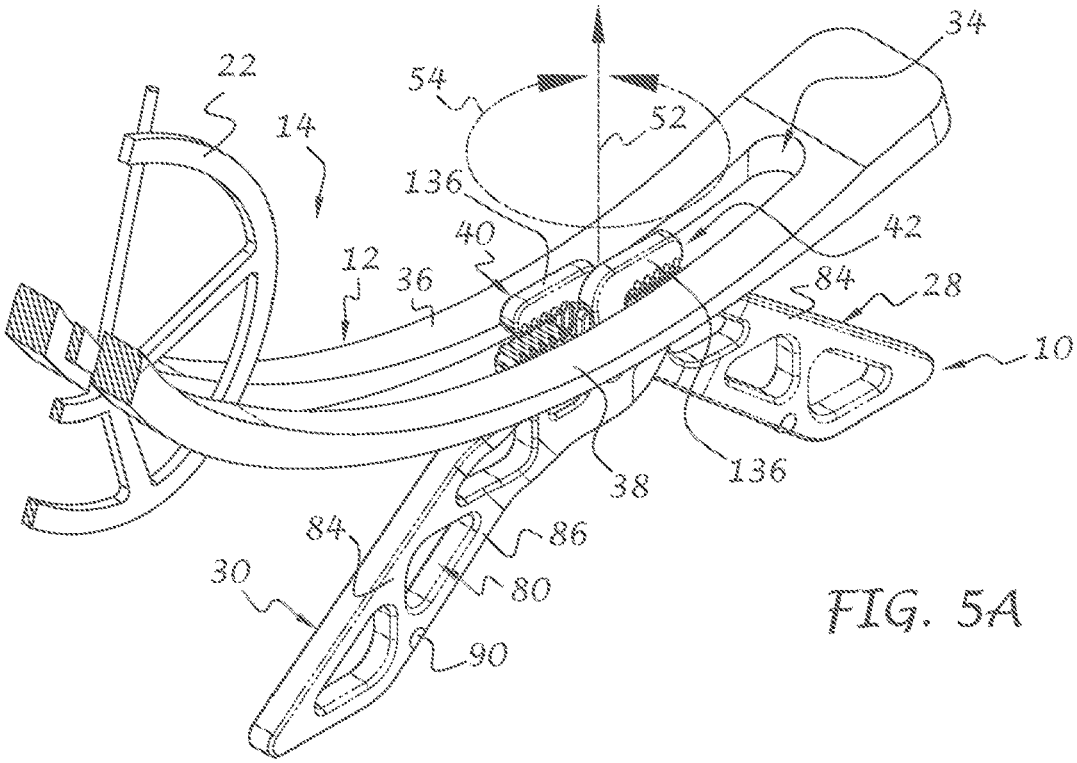
FIG. 5A is a view similar to FIG. 5 showing the archery bow stand in the open position parallel with the slot in the split limb portions and positioned for rotation about a longitudinal axis of the archery bow stand to thereby position the clamping portions of the archery bow stand with the inner edges of the split limbs, until the bow stand of the invention is oriented at least approximately perpendicular to the bow limbs to thereby securely attach the archery bow stand to the split limb bow.

Referring now to FIGS. 5 and 5A, the archery bow stand 10 is connected to the lower split limb 12 of the archery bow 14 by rotating the bow stand 10 to the fully open position until the first clamp portion 42 and second clamp portion 44 are parallel. In this position, the clamp portions extend in opposite directions. The open bow stand 10 is then oriented so that the opposing clamp portions 42, 44 are aligned with the elongate slot 34, as shown in FIG. 5. The bow stand 10 is then moved toward the slot 34, as represented by arrow 50 in FIG. 5, until the first and second clamp portions 42 and 44 are located in the slot 34, as shown in FIG. 5A. The open bow stand is then rotated either clockwise or counter-clockwise about a center axis 52 of the bow stand 12, as represented by double arrow 54, until the clamp portions 42 and 44 are positioned over their respective lower limb segment 38 and 36, respectively, as shown in FIG. 1, to thereby support the archery bow 14 in the upright position on a surface 24.

With the clamp portions located centrally in the slot 34 and extending outwardly over and under the lower limb segments 36 and 38, the archery bow stand 10 can accommodate archery bows with split limbs of practically any width. Thus, the present invention is advantageous over prior art archery bow stands that are constructed to grasp the outer edges of the lower limb and, as a result, are only capable of being connected to archery bows with relatively narrow single-piece limbs or split limbs.

Figure 6:
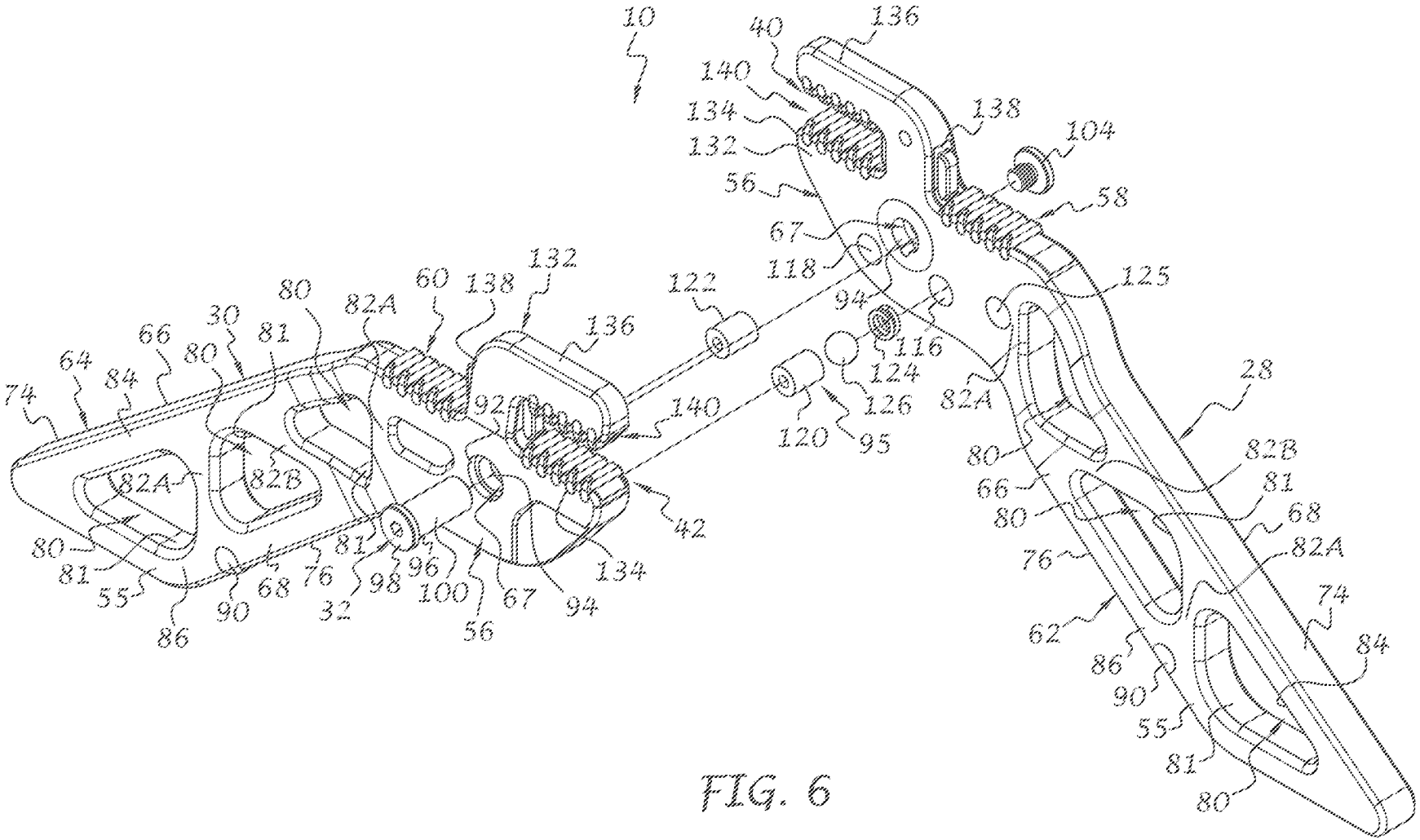
FIG. 6 is an exploded front isometric view of the archery bow stand in accordance with the invention, showing first and second leg members and connecting components operatively associated with the legs for pivoting and locking the leg members in both open and closed positions.
Figure 7:
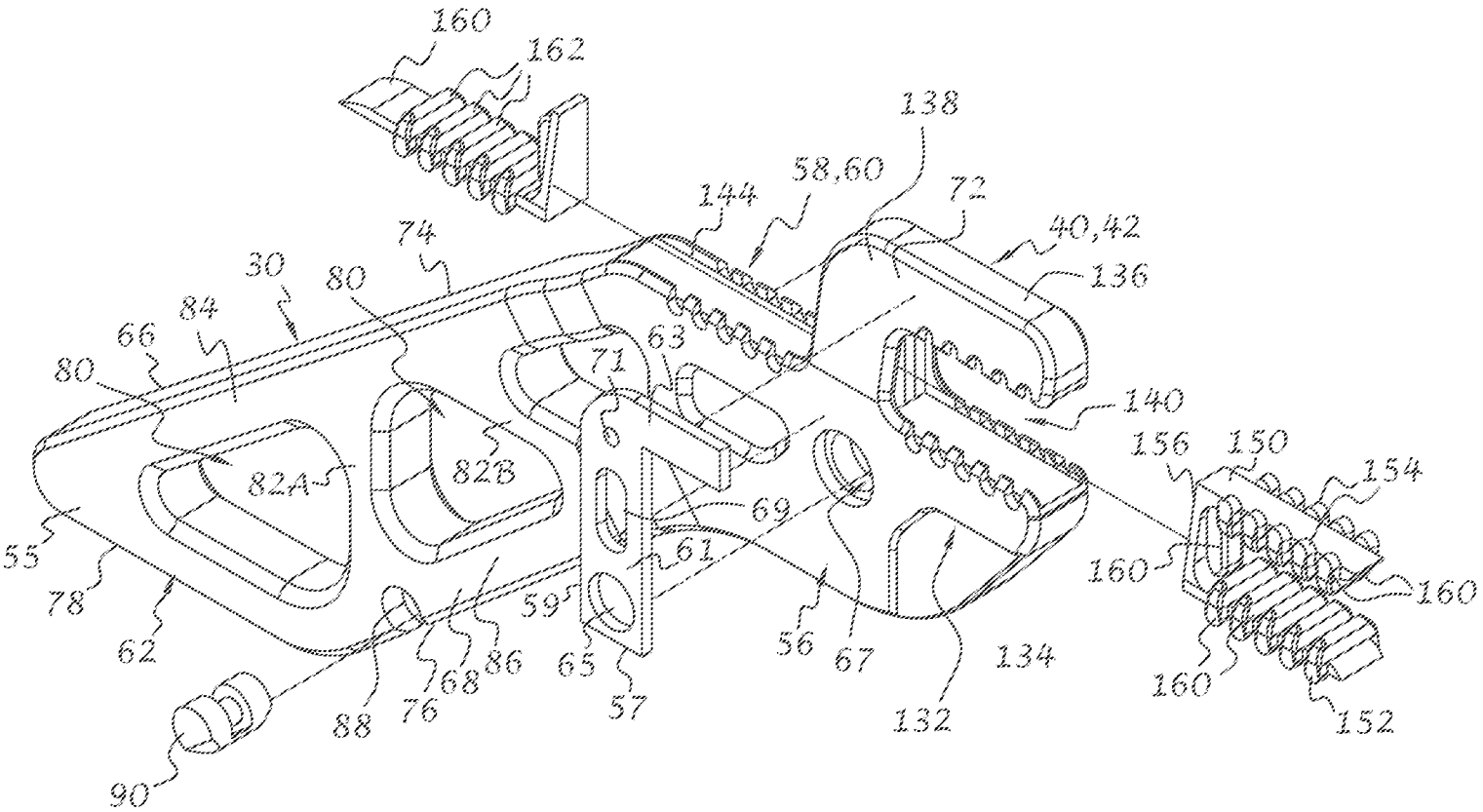
FIG. 7 is an exploded front isometric view of one of the leg members of the archery bow stand, illustrating co-molded components for engaging the bow limbs or other features associated with the bow without marring the bow yet enabling secure clamping for different limb thicknesses.

Referring now to FIGS. 6 and 7, the archery bow stand 10 in accordance with an exemplary embodiment of the invention includes the first leg 28 pivotally connected to the second leg 30 via the pivot joint 32 for relative rotation between open and closed positions of the archery bow stand 10, as described above. The legs 28, 30 are preferably identical in construction, and thus the description of one leg will apply to the other and vice-versa, with like features of each leg being represented by like numerals, except where indicated.

Each leg 28, 30 comprises an integral main body 55 that can be divided into different portions or sections for the purpose of facilitating the description of the present invention. The main body 55 thus generally includes an upper connecting portion 56 for connecting the legs 28, 30 together, a first upper clamp portion 40 and a second upper clamp portion 42 extending forwardly from the upper connecting portion 56 of the legs 28 and 30, respectively, for interchangeably clamping around the first and second lower limb segments 36 and 38, a first bow support portion 58 and a second bow support portion 60 extending rearwardly from the first clamp portion 40 and second clamp portion 42, respectively, to assist the second clamp portion 42 and first clamp portion 40, respectively, in supporting the bow in an upright position. The main body 55 also includes a lower support portion 62 extending downwardly and rearwardly from the upper connecting portion 56 at an obtuse angle with respect to the upper clamp portions 40, 42 for supporting the archery bow 14 in an upright position on the ground or other horizontal surface.

Referring now to FIGS. 7-10, each leg 28, 30 can be formed as a hybrid structure with the main body 55 being integrally molded or otherwise formed of a durable plastic material with a relatively high yield strength and a suitable modulus of elasticity that allows for some elastic deformation under the weight of the archery bow and various bow accessories that may be mounted thereto, including an arrow rest, bow sight, stabilizer, dampeners, and so on, without compromising the stability of the archery bow stand 10. Suitable materials can include, but are not limited to, plastic material such as PP, LDPE, HDPE, PVC, PET, PC, ABS, and so on, glass or carbon fiber-reinforced polymers or other composite materials, and so on.

In order to further strengthen the legs 28, 30, and thus the structure of the archery bow stand 10, support structure 57 (FIG. 8) comprising an L-shaped body 59 is integrally molded with the main body 55 during manufacturing, such as known insert-molding techniques. As best shown in hidden line in FIG. 8, the L-shaped body 59 is located at critical stress areas of each leg 28, 30, and preferably along the connecting portion 56 and clamp portion 40, 42 of each leg 28, 30. The support structure 57 preferably comprises a relatively thin sheet or plate of reinforcing material, such as steel or aluminum for example, to provide added stiffness and strength at the critical stress areas of each leg 28, 30. It will be understood that the main body 55 and support structure 57 are not limited to the particular shapes or materials described, but can include other shapes and/or materials, including other metals or alloys, composites, ceramics, and so on, without departing from the spirit and scope of the invention.

The support structure 57 includes a first segment 61 extending between the pivot joint 32 and the clamp portion 40 or 42, and a second segment 63 extending perpendicular from the first segment 61 and along the clamp portion 40 or 42. A first reinforcement opening 65 is formed in the first segment 61 in alignment with a stepped pivot bore 67 formed in the main body 55 and extending between an inner surface 66 and an outer surface 68 thereof. A second elongate reinforcement opening or slot 69 is formed in the first segment for reducing the weight of the support structure 57 and allowing plastic material in a heated fluid state to flow through and around the support structure during the molding process of the main body 55. A third relatively small opening 71 is formed in the support structure 71 near the intersection of the first segment 61 and second segment 63 for ensuring flow of plastic material through and around the support structure 57 during the molding process. The second segment 63, as best shown in hidden line in FIG. 8, extends from the first segment 61 and along an upper section 72 of the clamp portion 40 or 42 to strengthen the clamp portions against unwanted deformation when the archery bow is supported in the upright position by the archery bow stand 10. clouded With particular reference to FIGS. 6-8, the lower support portion 62 is elongate in shape and includes the inner surface 66 and outer surface 68 of the main body 55, an upper side surface 74 and lower side surface 76 each extending between the inner surface 66 and outer surface 68, and a bottom support surface 78 extending between the inner surface 66 and outer surface 68 and the upper side surface 74 and lower side surface 76. The bottom support surface 78 is adapted to contact the ground, floor, or other horizontal surface 24 (FIG. 1).

Since the legs 28 and 30 are identical in construction, they are oriented so that the clamp portion 40 of the leg 28 and the clamp portion 42 of the leg 30 extend in opposite directions. The inner surface 66 of the first leg 28 and the inner surface 66 of the second leg 30 thus face inwardly toward each other when assembled, and slide against each other when the legs 28, 30 are rotated about the pivot joint 32. Likewise, the outer surface 68 of the first leg 28 and the outer surface 68 of the second leg 30 face outwardly away from each other, as shown in FIG. 6 for example. In addition, as shown, the outer surface 68 of the first leg 28 and the inner surface 66 of the second leg 30 face forwardly, while the inner surface 66 of the first leg 28 and outer surface 68 of the second leg 30 face rearwardly. Accordingly, it will be understood that terms of orientation and/or position as used herein refer to relative, rather than absolute, orientations and/or positions.

In accordance with an exemplary embodiment of the invention, a plurality of holes 80 extend through each leg 22 and 24 between the first and outer surfaces 66 and 68, respectively, to reduce the amount of material needed with its attendant weight, without compromising the structural integrity of the legs 28, 30 of the archery bow stand 10. The holes 80 are shown as generally triangular shape with the apex 81 of one triangular hole 80 pointing outwardly and the apex 81 of an adjacent triangular hole 80 pointing inwardly to form vertical cross beams or webs 82A and horizontal cross beams or webs 82B extending between an outer chord or strut 84 associated with the outer surface 74 and an inner chord or strut 86 associated with the inner surface 76 of each leg 28, 30. The webs 82A, 82B, outer chord 84, and inner chord 86 of each leg 28, 30 bear the load of the archery bow 14 and any accessories or components mounted on the bow, as previously described.

With the above-described exemplary embodiment of the invention, when the archery bow 14 is held in the upright position on a horizontal surface by the archery bow stand 10 in the open position, with the bottom support surface 78 of the leg 28 and the bottom support surface 78 of the leg 30 spaced in a relatively wide stance as shown in FIGS. 3 and 4 for example, the outer chords 84 and inner chords 86 of the legs 28 and 30 are parallel and oriented diagonally, while the webs 82A are positioned vertically and the webs 82B are positioned horizontally. With the legs 28 and 30 connected together at the pivot joint 32 and the clamp portions 40, 42 extending around their associated split limb sections 36, 38, the diagonally positioned parallel chords 84 and 86 together with the vertical webs 82A and horizontal webs 82B form a double truss configuration, such as a quadrangular truss configuration, parallel chord scissor configuration, or the like, with tensile forces generally acting on the diagonal chords 84, 86 and compressive forces acting on the vertical webs 82A. Such a configuration is particularly advantageous for supporting relatively large loads while maximizing the span or width between the bottom support surfaces 78 of the legs 28 and 30 to thereby create greater stability for both the archery bow 14 and the archery bow stand 10 when holding the archery bow in the upright position, as shown in FIG. 1 for example.

Thus, the particular double truss configuration of the bow stand 10 in accordance with an exemplary embodiment of the present invention creates a strong load-bearing structure across a relatively wide stance between the bottom support surfaces 78 of the legs 28 and 30 in the open position, thereby minimizing deformation in the legs 28, 30, and providing increased stability of the archery bow stand 10 in conjunction with the archery bow 14 when connected together as shown in FIG. 1 for example.

Figure 11:
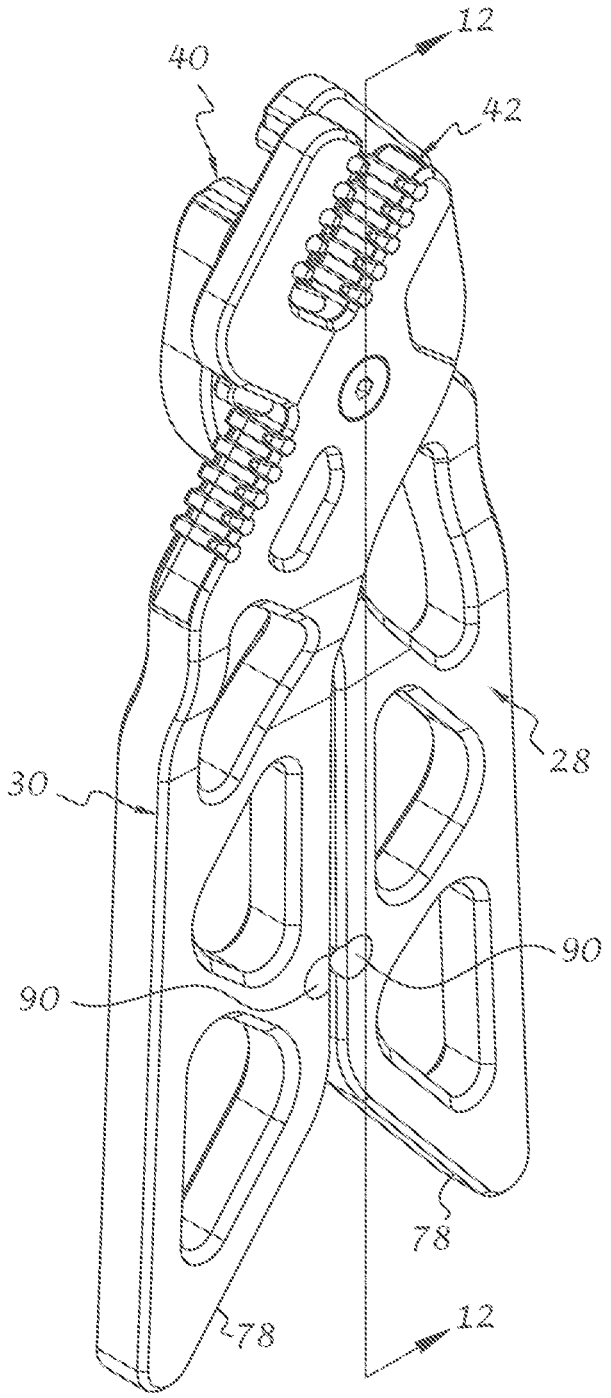
FIG. 11 is a front isometric view of the archery bow stand of the invention in a closed position.

As shown in FIGS. 6, 7, and 11, a stepped generally cylindrical hole 88 (FIG. 7) is formed in the inner chord 86 of each leg 28 and 30, intersecting the inner surface 76 and extending between the inner surface 66 and outer surface 68. A stepped generally cylindrical bumper 90 complementary in shape to the hole 88, is positioned in the hole 88 of each leg 28, 30 so that a portion of the bumper extends from the inner surface 76 as a convex protrusion. The bumper 90 is preferably constructed of resilient elastomeric material, such as rubber, neoprene, silicone, or other suitable material and installed in the hole 88 by friction fit, adhesive bonding, or other known connecting means.

When the archery bow stand 10 is in the closed position, as shown in FIG. 11, the bumpers 90 protrude sufficiently toward each other to be in mutual contact when the bow stand 10 is in the closed position to cushion and silence the legs 28 and 30 when rotated toward the closed position. Although the bumpers 90 are shown as separate parts and installed in the holes 88 of each leg portion, it will be understood that the bumpers 90 can be formed together with the main body 55 during manufacture. In accordance with a further embodiment of the invention, a resilient cover (not shown) can be formed as an overmolded component on the main body 55 of each leg 28, 30 during manufacture.

Although a particular configuration of the legs 28 and 30 is shown and described, it will be understood that the leg configurations can greatly vary without departing from the spirit and scope of the invention, including the various openings, as well as the relative leg size, shape, thickness, length, and so on. It will be further understood that each leg need not be identical, but may have various dimensional, design, and functional features unique to each leg.

Referring now to FIGS. 6-10, the connecting portion 56 of each leg 28, 30 includes the pivot joint 32 and a detent assembly 95 operably associated with the pivot joint for limiting the relative pivoting or rotational motion of the legs 28, 30. The pivot joint 32 enables relative rotation of the legs 28, 30 between the closed position (FIG. 11) for storing and/or transporting the bow stand 10 and the open position (FIG. 1) for supporting an archery bow 14 in an upright position. The detent assembly 95 operates in conjunction with the pivot joint 32 for ensuring that the legs 28, 30 are rotated to and held at a first predetermined relative angular position defining the closed position of the bow stand 10. Likewise, the detent assembly 95 also ensures that the legs 28, 30 are rotated to and held at a second predetermined relative angular position defining the open position of the bow stand 10.

Figure 9:
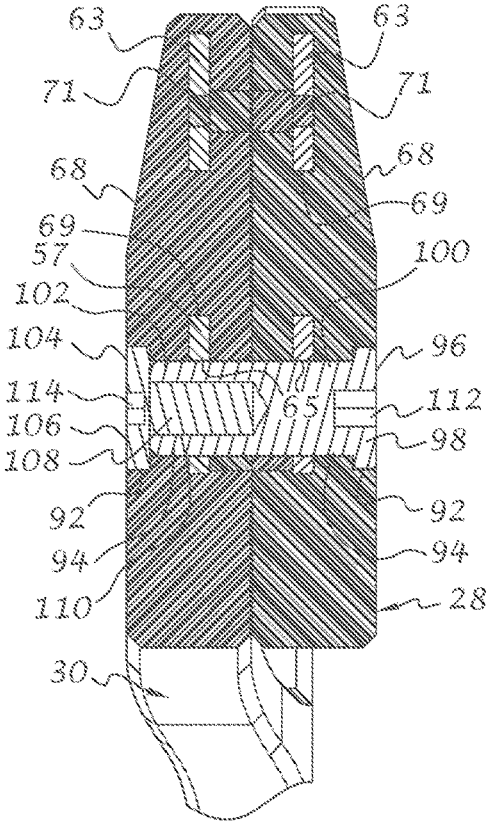
FIG. 9 is an enlarged cross-sectional view of the archery bow stand in the open position, taken along line 9-9 of FIG. 8 illustrating the pivoting connection in accordance with an exemplary embodiment of the invention.

Referring now to FIGS. 6, 7, and 9, the pivot joint 32 includes a stepped pivot bore 67 formed in the main body 55 of each leg 28, 30, as previously described. The stepped pivot bore 67 has a first bore section 92 with a first diameter extending into the main body 55 of each leg 28, 30 from the outer surface 68, and a second elongate bore section 94 with a second diameter smaller than the first diameter extending from the first bore section to the inner surface 66, so that the stepped pivot bore 67 extends completely through each leg 28, 30. The first reinforcement opening 65 (FIG. 7) formed in the first segment 61 of the support structure 57 is in alignment with the second bore section 94 and has a diameter approximately equal to, or slightly larger than, the second bore section 94 formed in the main body 55 to reinforce the stepped pivot bore 67, as previously described.

As best illustrated in FIG. 9, a first fastener 96 is provided with a first circular fastening head section 98 and a first elongate shaft section 100 extending therefrom. The first head section 98 is positioned in the first bore section 92 of the first leg 28 with the first elongate shaft section is positioned in both the second elongate bore sections 94 of the first leg 28 and second leg 30. An internally threaded bore 102 (best shown in FIGS. 9 and 12) is formed at an opposite end of the shaft section 100 for receiving a second fastener 104 having a second circular fastening head section 106 and a second shaft section 108 with outer threads 110 formed thereon that mate with the internally threaded bore 102 to secure the fasteners 96 and 104 together with the first leg 28 and second leg 30 pivotally connected to the elongate shaft section 100 and held in place by the first and second fastening head sections. Preferably, the fastening head sections are flush with or slightly below the outer surface 68. A hex-shaped depression 112 is formed in the fastening head section 98 and a hex-shaped depression 114 is formed in the fastening head section 106 for engagement with a hex tool or the like when assembling the legs 28, 30 together, as well as adjusting the resistance to relative pivotal movement of the legs between open and closed positions.

When the fastening head sections are rotated in a direction to further tighten the legs 28, 30 together, for example, the normal compressive forces applied by the fastening head sections on the legs 28, 30 increases, thereby increasing the frictional force between the inner surfaces 66 of the legs 28 and 30 during pivotal movement about the elongate shaft section 100. The amount of friction can be adjusted to a desired level by loosening or tightening the first and second fasteners to thereby adjust the amount of force needed to rotate the legs 28, 30 between the closed and open positions.

It will be understood that the present invention is not limited to the particular manner described and illustrated herein for pivotally connecting the legs 28 and 30 together. For example, the above-described method can be reversed, where the first and second fasteners are positioned in the second and first legs, respectively, since the legs 28 and 30 are identical and therefore interchangeable.

It will be further understood that the present invention is not limited to the particular fasteners shown and described for pivotally connecting the legs 28, 30 together, but can include various means for pivotally connecting the legs together without departing from the spirit and scope of the invention.

Figure 10:
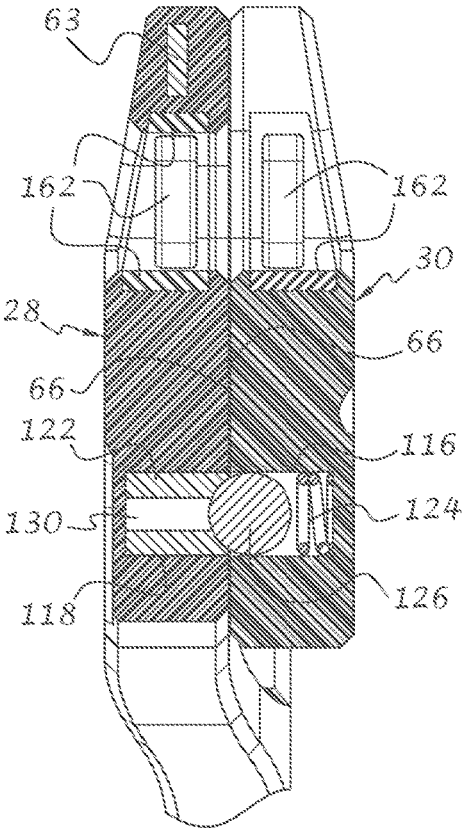
FIG. 10 is an enlarged cross-sectional view of the archery bow stand in the open position, taken along line 10-10 of FIG. 8 illustrating the detent mechanism in a first position for holding the archery bow stand in the open position.
Figure 12:
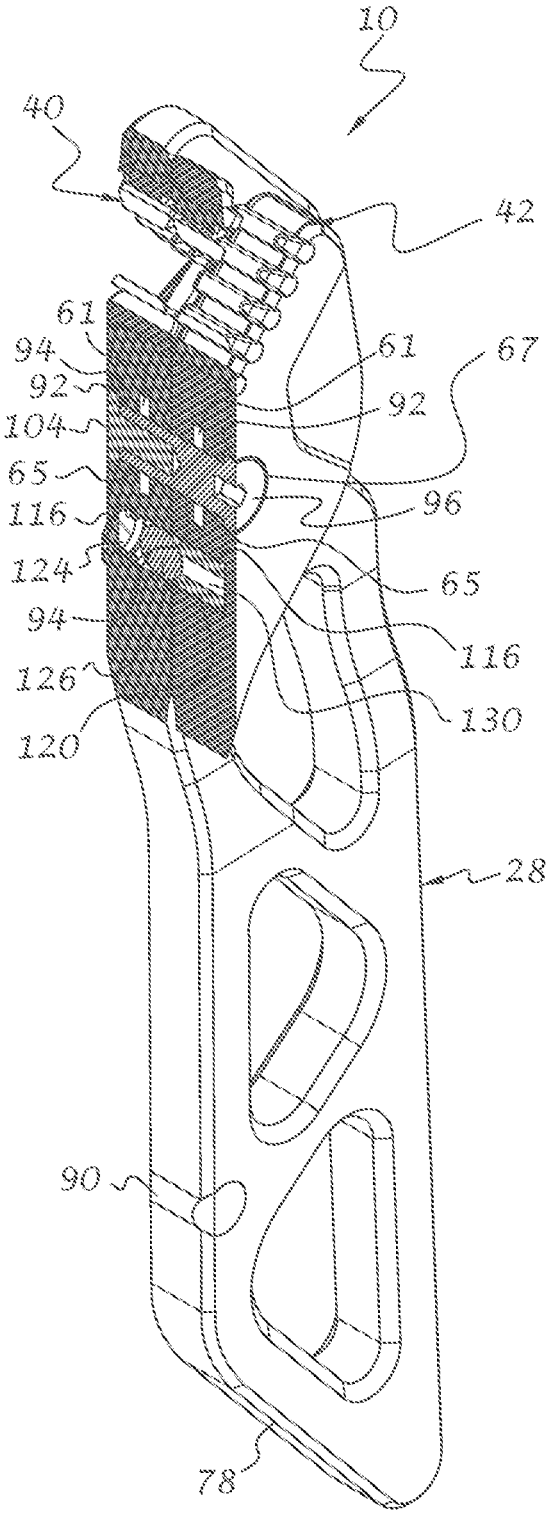
FIG. 12 is an enlarged cross-sectional view taken along line 12-12 of FIG. 11 illustrating the pivoting connection and locking mechanism in a second position for locking the archery bow stand in the closed position.

As best shown in FIGS. 6, 10, and 12, the detent assembly 95 preferably includes a first detent opening 116 and a second detent opening 118 of size and depth are formed in the main body 55 from the inner surface 66 of each arm 28, 30. A first cylindrically shaped detent member 120 and a second similarly shaped detent member 122 are inserted into each detent opening 116 and 118 in one of the arms 28 and 30, while a compression spring 124 and ball 126 are inserted into the detent opening 116 of the other arm 28, 30. As shown in FIG. 6 for example, the compression spring 124 and ball 126 are inserted into the detent opening 116 of the first leg 28. A countersunk bore 130 is formed in each detent member 120, 122 for receiving a portion of the ball 126 when aligned therewith to thereby create a positive detent position. When the legs 28, 30 are in the closed position, the detent openings 116 of the legs align, as shown for example in FIG. 12. Likewise, when the legs 28, 30 are rotated to the fully open position, the detent opening 116 of one leg is aligned with the detent opening 118 of the other leg so that the ball 126 under biasing forces from the spring, positively locates in the countersunk bore 130 of the detent member 120 or 122 (depending on which detent hole it is inserted in) to thereby form a second positive detent position defining the fully open position.

As shown in FIG. 12, the pivot joint 32 works together with the detent assembly 95 for adjusting the rotational force or the force resistant to rotation between the legs 28, 30 during pivotal movement between the predetermined closed and open positions. In the closed position in FIG. 12, the ball 126 is aligned with the detent member 120 under the biasing force from the compression spring 124. The first fastener 96 with the head section 98 and elongate shaft section 100 and the second fastener 104 with the head section 106 and outer threads 110 extend through the legs 28, 30 with the head sections 98 and 106 holding the legs in place while permitting relative pivotal movement. When the first and second fasteners are further tightened, the compression spring 124 and ball 126 are further compressed between the first and second legs, with the ball 126 riding on the inner surface 66 outside of the detent members 120, 122, such as when the legs are rotated somewhere between the fully open and fully closed detent positions, thereby causing greater forces to pivot the first and second legs relative to each other. When the fasteners 96 and 104 are loosened, the forces of the ball 126 on the inner surface 66 will be less, thereby causing smaller forces to pivot the legs relative to each other. Accordingly, the compression spring 124 and ball 126 can be advantageously used to adjust the desired rotational forces either alone or in combination with the frictional contact between the inner surfaces 66 of the legs 28 and 30, as previously described.

In accordance with a further exemplary embodiment of the invention, the legs 28 and 30 can be configured or otherwise connected or arranged so that the inner surfaces 66 of the legs 28 and 30 are spaced apart to eliminate frictional forces therebetween when the legs are rotated about the pivot joint 32, so that only the ball 126 associated with one leg 28 for example, is pressed against the inner surface 66 associated with the other leg 30 for example, to thereby function as the sole means for adjusting the frictional force therebetween and thus the resistance of the leg members to rotational movement about the pivot joint 32.

Referring now to FIG. 6, a boss 125 is positioned on the inner surface 66 of the first leg 28 and/or second leg 30. The bump 125 is located at a position to allow rotation of the legs 28 and 30 to the fully open position, but blocks further rotation toward the open position to thereby ensure that the archery bow stand 10 stays within a predetermined maximum limit of rotation where integrity of the bow stand remains uncompromised in the event that the legs 28, 30 pivot beyond the open detent position. The boss 125 can be integrally molded with the first and/or second leg 28, 30, or formed separately and mounted in a hole (not shown) or the like. When formed separately, the boss 125 can be constructed of elastomeric material with a high coefficient of friction to function as a brake against further rotational movement beyond the predefined open position.

Figure 8:
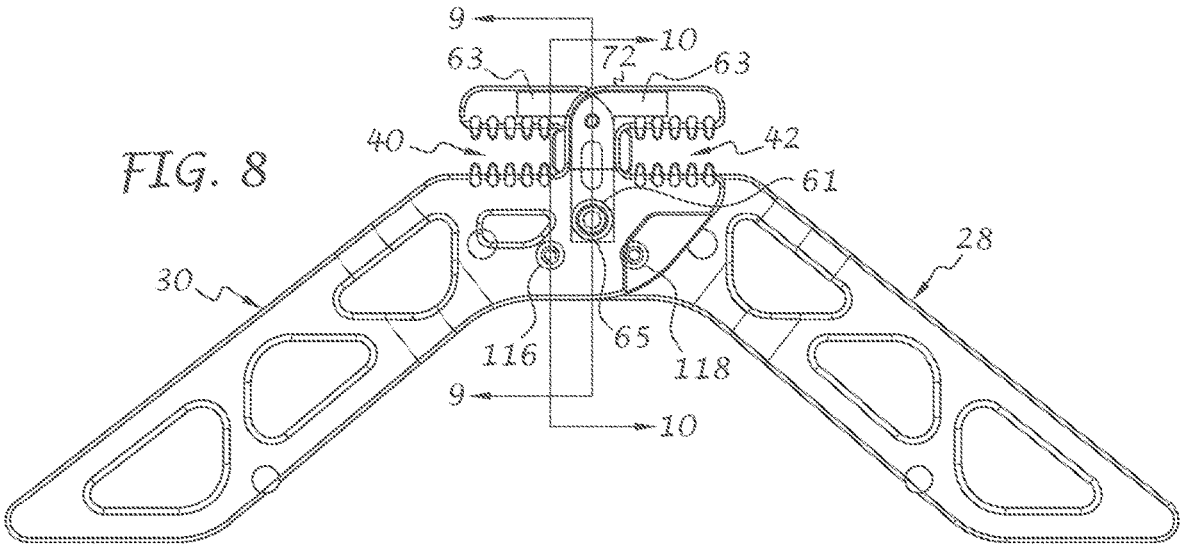
FIG. 8 is a front elevational view of the archery bow stand of the invention in an open position, with particular components or features thereof shown in hidden line.

Referring now to FIGS. 3, 6, and 8, the clamp portion 40 associated with leg 28 and the clamp portion 42 associated with leg 30 preferably include a C-shaped jaw section 132 facing outwardly from the connecting portion 56, with a lower clamp section 134, an upper clamp section 136 extending parallel with the lower clamp section, and an upright side wall clamp section 138 extending between the lower clamp section 134 and the upper clamp segment 136 so that the upper clamp section is cantilevered over the lower clamp section. An open gap 140 is formed between the lower clamp section 134 and the upper clamp section 136 for receiving one of the lower limb segments 36, 38 (FIG. 5A) when rotated within the slot 34 located between the limb segments 36, 38. The bow stand is then rotated either clockwise or counter-clockwise about the center axis 52 of the bow stand 12, as represented by double arrow 54, until the C-shaped jaw section 132 of each leg 28, 30 is positioned over its respective lower limb segment 38 and 36, as shown in FIG. 1, to thereby support the archery bow 14 in the upright position on a surface 24.

When the split-limb archery bow is supported in a vertical position on the archery bow stand 10 as shown in FIG. 1, with the C-shaped jaw sections extending generally perpendicularly to the orientation of the limb segments 36 and 38, each of the first bow support portion 58 and the second bow support portion 60 preferably includes a horizontal support shelf or ledge 144 that extends rearwardly from the first clamp portion 40 and the second clamp portion 42, respectively. The support ledge 144 provides a further horizontal support for each lower limb segment 36 and 38, to thereby further stabilize the split-limb archery bow 14 on the archery bow, while strengthening the first and second clamp portions 40 and 42.

As best shown in FIG. 7, a resilient C-shaped clamp cover 150 is provided for protecting and adjusting each clamp portion 40, 42. The resilient C-shaped clamp cover 150 preferably includes a lower cover section 152 extending over the lower clamp section 134, an upper cover section 154 extending over the upper clamp section 136, and a side wall cover section 156 extending over the side wall segment 138 so that only the resilient material of the cover 50 contacts the split limb segments to thereby eliminate or at least minimize damage to the limb segments. Each cover section of the cover 150 is preferably formed with a plurality of resilient, deformable fingers 160 that extend parallel to each other and perpendicular to the lower clamp section, the cantilevered upper clamp section of the clamp portion 40, 42. One or more upper clamp sections also be provided on the side wall cover section 156. The upper clamp sections are preferably constructed of a resilient material such as rubber or other elastomeric material, open-cell polyurethane foam, silicon, and so on, so that the clamp portions 40, 42 are adjustable to the particular thickness or varying height of the lower limb segments 36 and 38 associated with different split limb archery bows.

Likewise, a resilient cover 160 extends over the horizontal shelf 144 to protect the limb segments 36 and 38 that would otherwise occur when the bow stand 10 is connected to the split-limb bow 14. Parallel fingers 162 formed along the resilient cover 160 help to further protect the bow limb 12 or other structure from scratches and localized contact forces when the bow stand 10 is clamped therearound and positioned for properly holding the bow in a bipod or tripod support configuration, as previously described, and as shown in FIGS. 1 and 2. The deformable nature of the fingers 162 ensure that the limb segments 36 and 38 are adjustable in height with the finger sections 160 additionally supported at a height substantially equal to the height resilient cover 90 can be formed as an overmolded component or can be formed separately and attached to the C-shaped jaw section through adhesive bonding or other known connecting means.

In accordance with an exemplary method of constructing the bow stand 10, the legs 28 and 30 can be formed of any suitable material, such as plastic, via injection molding, or metal via machining, and so on, and then placed into an injection mold, and a second material, such as an elastomeric material, can be over-molded around the legs to form the resilient or cushioned portions of the bow stand 10 that will protect the split limbs of the bow as well as other related components. In this manner, the two materials are permanently joined as an integral structure, and work together to produce a bow stand that is strong, light weight, aesthetically pleasing, and practical to the purchaser or end user. Post processing of the combined two-part assembly can then be performed. Other retaining apertures or slots, besides those previously described with respect to the reinforcing member and main body portion, can also be formed in the legs and/or resilient material, and a corresponding number of retaining bumps or projections of complementary shape and size can be formed in the resilient material and/or the legs so that the more rigid structure and more flexible, resilient material are fixed together against relative slidable movement without the need for adhesives or extra assembly steps. During over-molding, the flexible material can flow into retaining grooves and around retaining projections or bumps to thereby create an integral structure.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. For example, although the openings are shown as extending through the thickness of the legs, it will be understood that the openings can be in the form of depressions or the like that do not extend entirely through the legs.

Likewise, the openings in the legs can be eliminated in accordance with a further embodiment of the invention without affecting the operation of the archery bow stand.

It will be further understood that, in accordance with a further embodiment of the invention, the legs can be separable rather than permanently connected together when not in use, so that the footprint of the bow stand can be minimized during storage and transportation.

In accordance with yet a further embodiment of the invention, the legs 28, 30 need not be identical, but can comprise different shapes or configurations operably connected together to support a split-limb archery bow in an upright position. Thus, the leg 28 for example can include the first clamp portion 40 and the second clamp portion 42 arranged back-to-back in an H-shape double clamp configuration so that the clamp portions face opposite directions for engaging opposing inner edges of the split limb segments in the elongate slot when the H-shaped double clamp configuration of the leg 28 is positioned in the slot between the limb segments and rotated either clockwise or counterclockwise to position the clamp portions around the different limb segments. The leg 30 can then be rotated to an open position to form the tripod mounting arrangement as previously described with respect to the previously disclosed embodiment with identical legs 28 and 30.

It will be understood, therefore, that the present invention is not limited to the particular embodiments disclosed, but also covers modifications, features, shapes, and configurations within the spirit and scope of the invention as defined by the appended claims.

What is claimed is:

1. A bow stand for supporting an archery bow having a lower split limb portion with first and second limb segments separated by an elongate slot, the bow stand comprising:

at least one leg for supporting the archery bow;

at least one upper clamp portion associated with the at least one leg and including:

an upright clamp section;

a lower clamp section extending perpendicularly from the upright clamp section;

an upper clamp section spaced from the lower clamp section and extending perpendicularly from the upright clamp section;

at least one open gap formed between the upright clamp section, the upper clamp section, and the lower clamp section, the at least one gap being of sufficient height for receiving at least one of the first and second limb segments;

wherein the at least one upper clamp portion is adapted for being positioned in the elongate slot in a first orientation with the upper clamp portion extending parallel with the limb segments, and is rotatable about a vertical axis to a second orientation perpendicular to the first orientation such that the upper clamp section is oriented perpendicular to the first and second limb segments with the at least one open gap receiving at least one of the first and second limb segments to thereby retain the lower split limb portion on the bow stand.

2. A bow stand according to claim 1, wherein the at least one upper clamp portion comprises:

first and second upper clamp portions identical in construction;

the first upper clamp portion extending in a first direction and the second upper clamp portion extending in a second direction opposite the first direction;

the at least one open gap comprises a first open gap extending in the first direction and a second open gap extending in the second direction;

wherein the first and second upper clamp portions are adapted for insertion into the elongate slot in a first orientation, with the first and second upper clamp portions extending parallel with the limb segments in the first and second directions, respectively, and are rotatable about the vertical axis to the second orientation perpendicular to the first orientation such that the first upper clamp section is oriented perpendicular to the first limb segment with the first open gap receiving the first limb segment; and the second upper clamp section is oriented perpendicular to the second limb segment with the second open gap receiving the second limb segment.

3. A bow stand according to claim 2, wherein the at least one leg comprises:

a first leg extending rearwardly and downwardly from the first upper clamp portion; and a second leg extending forwardly and downwardly from the second upper clamp section; and the first and second legs having an upper connecting section for pivotally connecting the legs together such that the first and second legs are relatively rotatable between a closed position for storing the bow stand and an open position for retaining a split-limb archery bow in an upright position.

4. A bow stand according to claim 3, wherein the first and second legs, including the first and second clamp portions, are identical in construction, with the first leg and first clamp portion oriented in the first direction and the second leg and second clamp portion oriented in the second direction opposite the first direction.

5. A bow stand according to claim 4, wherein the first and second clamp portions are angled upwardly in opposite directions when the bow stand is in the closed position.

6. A bow stand according to claim 5, wherein the first and second clamp portions are aligned horizontally so that the first and second open gaps extending in the first and second directions, respectively, are adapted to rotate simultaneously in the elongate slot so that the first and second limb segments are simultaneously engaged by the first and second clamp portions when rotated about the vertical axis to thereby retain the split-limb archery bow in an upright position.

7. A bow stand according to claim 4, wherein each of the first and second legs comprises:

a main body with an outer surface, a spaced inner surface parallel to the outer surface, and upper and lower side surfaces extending between the outer and inner surfaces;

wherein the inner surfaces of the first and second legs face each other when the legs are pivotally connected together, while the outer surfaces thereof face in opposite directions.

8. A bow stand according to claim 7, and further comprising:

a pivot section located adjacent to the upper clamp section of each leg, and comprising:

a first bore section formed in the outer surface of the main body and having a first diameter;

a second bore section having a second diameter smaller than the first diameter, the second bore section extending through the main body from the first bore section to the inner surface of the main body;

a first fastener having an elongate shaft extending through the second bore section of each leg, with a first mounting head at a first end thereof located in the first bore section of one of the legs, and an internally threaded bore located at a second end thereof and terminating at the first bore section of the other leg;

a second fastener having an outer threaded portion located in the first bore section of the other leg for coupling with the internally threaded bore; so that the first leg and second leg are relatively pivotable about the elongate shaft between the closed and the open positions.

9. A bow stand according to claim 8, and further comprising a detent assembly having at least two detent positions for defining a relative first rotational position between the first and second legs indicative of the closed position, and a relative second rotational position indicative of the open position of the bow stand.

10. A bow stand according to claim 9, wherein the detent assembly comprises:

a pair of spaced detent holes formed in the inner surface of each leg;

a cylindrical detent device located in the pair of spaced detent holes associated with one of the legs; and a compression spring and ball bearing located in one of the detent holes associated with the other of the legs, such that the ball bearing is biased toward the inner surface of the one leg, with a detent position being reached when the ball bearing engages with one of the cylindrical detent devices.

11. A bow stand according to claim 10, wherein each leg comprises:

a plurality of triangular openings extending through the outer and inner surfaces of the main body portion, with a first apex of a first triangular opening being located near the upper side surface and a second apex of a second triangular opening adjacent to the first triangular opening located near the lower side surface of the main body portion, to thereby form a truss member with an angled outer chord associated with the upper side surface, an angled inner chord associated with the lower side surface and parallel with the outer chord, and vertically and horizontally oriented webs formed between the triangular openings.

12. A bow stand according to claim 11, wherein the first and second legs positioned in the open position and pivotally connected together form a double truss configuration.

13. A bow stand according to claim 8, wherein each leg comprises:

a plurality of triangular openings extending through the outer and inner surfaces of the main body portion, with a first apex of a first triangular opening being located near the upper side surface and a second apex of a second triangular opening adjacent to the first triangular opening located near the lower side surface of the main body portion, to thereby form a truss member with an angled outer chord associated with the upper side surface, an angled inner chord associated with the lower side surface and parallel with the outer chord, and vertically and horizontally oriented webs formed between the triangular openings.

14. A bow stand according to claim 13, wherein the first and second legs positioned in the open position and pivotally connected together form a double truss configuration.

15. An archery bow stand for supporting an archery bow in an upright position, the archery bow having a lower split limb portion with first and second limb segments separated by an elongate slot, the archery bow stand comprising:

a first leg having a first lower support portion adapted for contacting a surface and a first upper clamp portion with a first gap facing a first direction for receiving the first limb segment; and a second leg having a second lower support portion adapted for contacting the surface and a second upper clamp portion with a second gap facing a second direction opposite the first direction for receiving the second limb segment; and the first and second legs being pivotally connected together in proximity to the first and second upper clamp portions for relative pivotal movement of the first and second legs to at least a first position where the first and second gaps are aligned;

wherein the first and second upper clamp portions are adapted to be received in the elongate slot of the lower split limb portion with the upper clamp portions extending parallel with the first and second limb segments, such that rotation of the archery bow stand about a vertical axis causes the first and second upper clamp portions to rotate in the elongate slot to a perpendicular position with respect to the first and second limb segments, such that the first gap receives one of the first and second limb segments and the second gap receives the other of the first and second limb segments to thereby retain the archery bow on the archery bow stand in the upright position.

* * * * *